United States Patent [19]

Smith

[11] 4,114,296

[45] Sep. 19, 1978

[54] INTERCHANGEABLE SANDAL

[76] Inventor: Gardner M. Smith, 9027 Eager Rd., St. Louis County, Mo. 63144

[21] Appl. No.: 803,658

[22] Filed: Jun. 6, 1977

[51] Int. Cl.[2] ..... A43B 3/24; A43B 13/08; A43B 13/38; A43B 3/12

[52] U.S. Cl. ..... 36/101; 36/33; 36/11.5; 36/44

[58] Field of Search ..... 36/100, 101, 86, 13, 36/33, 11.5, 43, 44, 30 R, 31, 32 R, 136; 12/146 B, 146 BP, 146 C

[56] References Cited

U.S. PATENT DOCUMENTS

| | | | |
|---|---|---|---|
| 2,153,968 | 4/1939 | Loufbahn | 36/101 |
| 2,607,133 | 8/1952 | Marlowe | 36/33 |
| 3,000,116 | 9/1961 | Ally | 36/101 |
| 3,570,147 | 3/1971 | Chiu | 36/100 |
| 3,686,779 | 8/1972 | Sachs | 36/101 |
| 3,983,642 | 10/1976 | Liao | 36/101 |
| 4,030,155 | 6/1977 | Azadian et al. | 36/86 |

*Primary Examiner*—Patrick D. Lawson
*Attorney, Agent, or Firm*—Ralph W. Kalish

[57] ABSTRACT

A shoe adapted for facile interchangeability into a multiplicity of styles comprising an outsole having a heel portion, with there being an intervening zone of flexure therebetween. Forward and rearward inner soles are provided on said outsole and with their adjacent end portions in overlapping relationship for relative slidability during foot movement. A retaining strap extending lengthwise of the shoe serves to optionally maintain a rear upper in operative position as well as to promote integration of the shoe components in selected mode of wear. A readily widthwise adjustable front upper or vamp is detachably mounted upon the forward portion of said outsole and replaceable by a thong detachable to the forward portion of the sole.

11 Claims, 10 Drawing Figures

FIG. 7
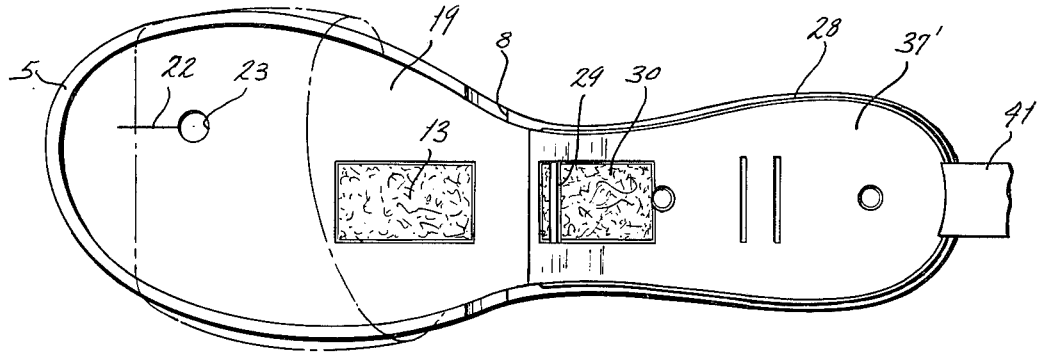
FIG. 8
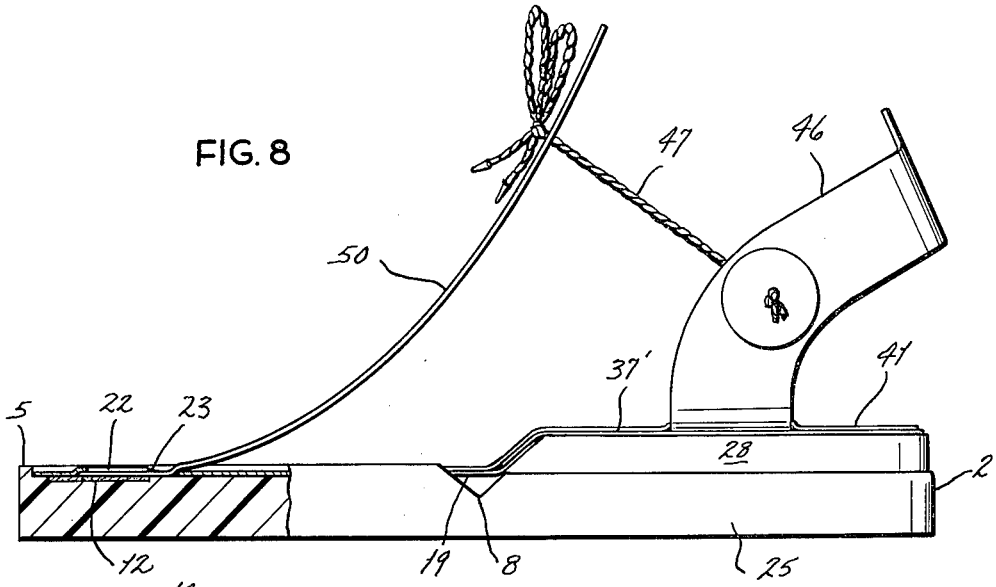
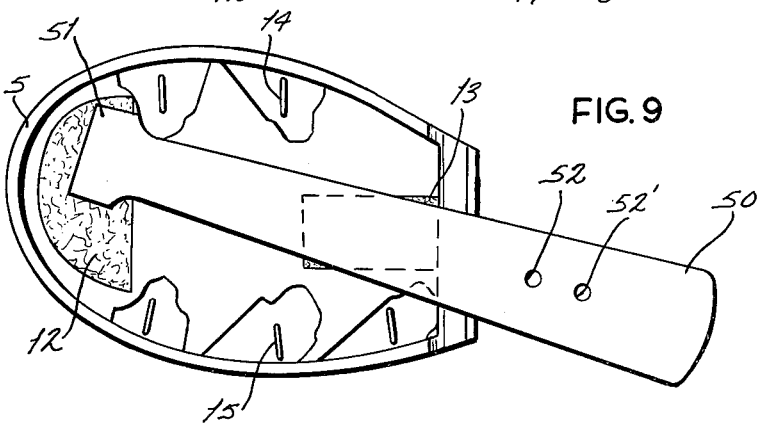
FIG. 9
FIG. 10
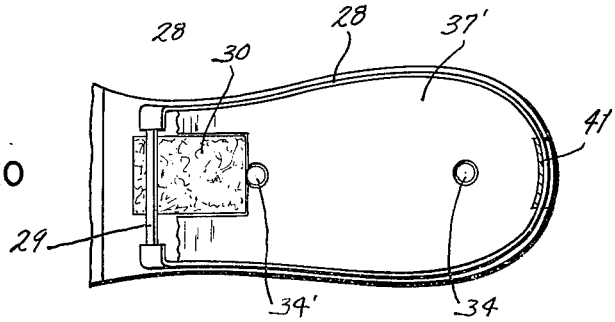

INTERCHANGEABLE SANDAL

BACKGROUND AND SUMMARY OF THE INVENTION

This invention relates in general to footwear and, more particularly, to a shoe of the general sandal character which is uniquely constructed for interchangeability of styling.

Heretofore, numerous efforts have been undertaken to develop women's shoes for adapting same for facile alteration by the wearer in order to present a variety of appearances and thereby conducing to the versatility of the shoe for different ensemble requirements and the like. Many of such earlier attempts have been directed primarily to what might be considered ornamental effects, such as shown in the patent to Santisi U.S. Pat. No. 2,759,284 and Bass 2,226,110. Other efforts which have been directed more toward alteration in the relationship of the components would be exemplified by the Marx U.S. Pat. No. 2,367,232 as well as that to Gardiner 2,761,224 and Cramer 2,509,423.

However, as merely exemplified by the aforementioned patents such earlier efforts have been of generally restrictive scope, presenting a relatively narrow range of styles.

With the present invention the potential for a relatively wide variety of distinct styles may be easily achieved by the wearer and without resort to extrinsic tools or the exercise of specialized skills. The shoe of the present invention is basically of the sandal type as worn by women both for formal, as well as informal, wear and which permits of the optional incorporation of a heel strap, a front upper or vamp, a thong for securement to a heel strap; and which also permits of width adjustability of the front upper as well as selectivity of heel styles, that is, either wedged or substantially flat.

Accordingly, the present invention is one of marked versatility and with the shoe embodying unusual expedients for presenting a variety of fashionable effects.

It is, therefore, an object of the present invention to provide a shoe designed for women and of generally sandal character embodying uniquely related components so as to endow the shoe with the facile capacity for alteration into one of numerous styles.

It is another object of the present invention to provide a shoe of the character stated which may be of platform type but embodying structural elements so related as to permit of ready bendability of the shoe within a zone intermediate the heel and sole to provide walking comfort not enjoyed to the present time in shoes of such nature.

It is a still further object of the present invention to provide a shoe of the character stated which embodies a retaining strip with cooperative elements through the easy manipulation of which the shoe's appearance may be quickly and easily altered.

It is a still further object of the present invention to provide a shoe of the character stated which comprehends a multiplicity of interchangeable constituents which may be easily disposed into chosen selective wearing disposition without resort to extrinsic tools and without requiring advance skill on the part of the wearer so that the average individual can quite simply and rapidly bring about the desired style within the range provided.

It is another object of the present invention to provide a shoe of the character stated which is adapted for supporting a readily detachable ornamental element corresponding to particular patterns or color arrangements utilized in other articles concurrently being worn or carried by the user.

It is another object of the present invention to provide a shoe of the character stated which may be most economically manufactured; which is extremely durable in usage; and which in and of itself serves the purpose of several pairs of shoes so as to bring about a substantial saving to the user.

BRIEF DESCRIPTION OF THE DRAWINGS

FIG. 7 is a top plan view of the sandal shown in FIG. 6, but with the heel strap removed and the retaining strap fragmentarily shown in disengaged condition.

FIG. 8 is a side elevational view, in partial section, of the sandal of the present invention adapted for incorporating a thong in lieu of a front upper or vamp.

FIG. 9 is a top plan view of the forward portion of the sandal illustrated in FIG. 8 but with the front inner sole removed illustrating the attachment of the thong.

FIG. 10 is a plan view taken on the line 10—10 of FIG. 6.

DESCRIPTION OF THE PRACTICAL EMBODIMENTS

Figure 4:
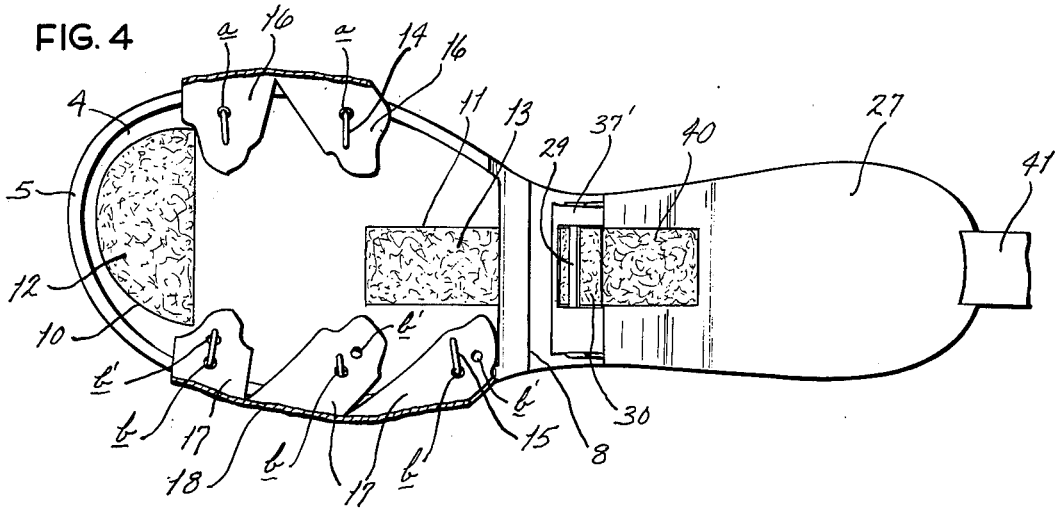
FIG. 4 is a top plan view with the rear and forward inner soles removed.

Referring now by reference characters to the drawings which illustrate practical embodiments of the present invention, A generally designates a woman's shoe of the broad sandal category and being of the character often colloquially referred to as "wedgie" in that the same embodies an outsole 1 and a heel 2 extending upwardly from the rear portion thereof, with the forward or instep-adjacent portion being downwardly inclined, as at 3. Outsole 1 is preferably of unitary molded construction from any suitable durable hard wearing material, such as rubber, rubber composition, plastic or resinous material, although, if desired, the same could be produced from leather, composite leather and wood. However, the molded construction is preferable. As may best be seen in FIG. 4 the forward upper portion of outsole 1 is depressed substantially throughout its extent to provide an upwardly opening recess 4 bounded by a relatively shallow upstanding rim 5. The forward portion of outsole 1 terminates in a transverse zone of flexure indicated generally at 6, with the forward portion thereof being constituted of a downwardly and rearwardly inclined surface 7 continuous with the rearward upper portion of outsole 1 and constituting, as it were, one side of a valley 8, the opposite side of which, as at 9, being comprised of an upwardly and rearwardly inclined surface substantially continuous with the forward face 3 of heel 2. Accordingly, as may best be seen in FIG. 5, said zone of flexure 6 constitutes a transversely progressing portion which is of reduced thickness relative to the forward portion of outsole 1 and heel 2 to conduce to bendability during wear and thereby permitting the user to walk in a natural fashion as distinguished from the usual flat-footed step normally necessitated by utilization of shoes having the customary, relatively thick platform soles.

Provided within recess 4 both in the forward or toe underlying portion thereof, as at 10, and in substantially the rearward central portion thereof, immediately forwardly of the zone of flexure, as at 11, are the female components 12, 13, respectively, for cooperative detachable engagement with interlocking male components to be described hereinbelow and for purposes to be shown. The particular nature of the interlocking components does not form a part of the present invention but in practice it has been found that the fastening system identified by the trademark "VEL-CRO" has proven most satisfactory from the standpoint of reliability and durability.

Embedded within the base of recess 4 along the inner side thereof just inwardly of rim 5 is a pair of hooks 14, the arms of which extend inwardly and in a parallel plane immediately above the base of recess 4. Three similar hooks, as at 15, are secured within sole 1 in generally opposed relationship to hooks 14 although being three in number by virtue of being disposed upon the normally outer portion of the forward portion of sole 1. Said hooks 14,15 are presented for engagement within openings *a,b,* respectively, which are punched or otherwise provided in finger-like extensions 16,17, respectively, formed on the inner and outer lateral portions of a front upper or vamp 18. Said fingers 16,17 being thus turned inwardly for disposition within recess 4 and underlying the wearer's foot during usage. It will be seen that vamp 18 is of the opened toe variety but such is manifestly a matter of choice since a closed toe could be provided, if desired, with the requisite arrangement of hooks 14,15. Each of said extensions 17 immediately inwardly of the related opening *b* is provided with a companion opening *b'* dimensioned for selectively receiving the particular hook 15 whereby the effective or foot-engaging portion of vamp 18 may be increased for appropriate accommodation of the wearer's foot. Thus, front upper 18 is peculiarly adapted for facile width adjustment by merely locking hooks 15 within the selected openings *b,b'* as the case may be of the associated extensions 17; there being no need to effect the disposition of extensions 16 as the same serve as an anchor, as it were, for front upper 18.

As would be expected the said extensions 16,17 and the intervening portions of the base of recess 4 are suitably covered by a front insole 19 having an opening 20 for exposure of the rearward female component 13 for reasons to be discussed shortly. Said front inner sole 19 may carry on its forward underface a section of the cooperating male fastener, as at 21, for effecting detachable but yet secure engagement of female fastener component 12 to conduce to stability of said inner sole in operative position.

Figure 2:
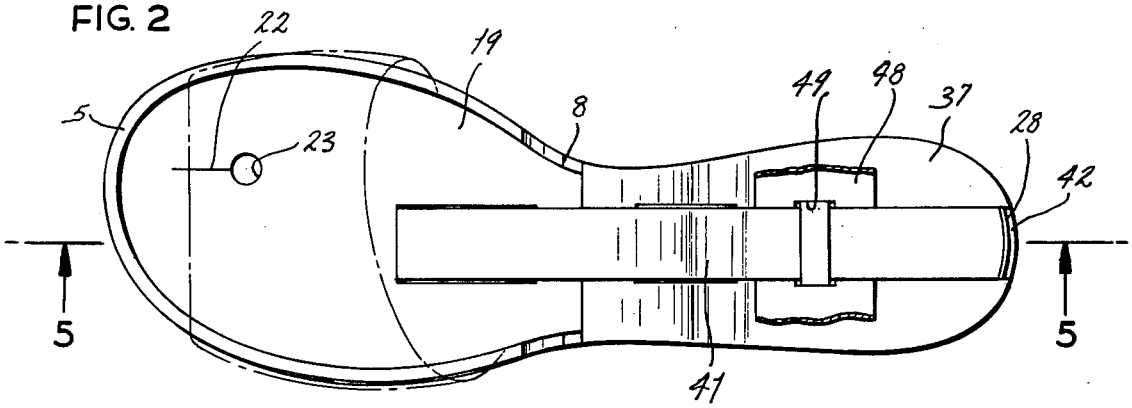
FIG. 2 is a top plan view of the sandal with the rear upper or heel strap broken away and the front upper or vamp shown in phantom lines.
Figure 3:
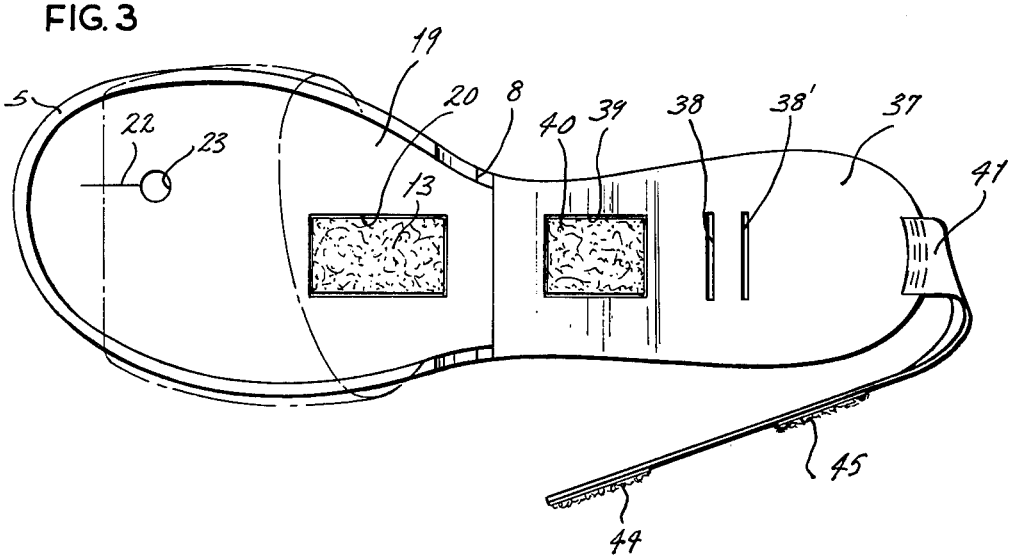
FIG. 3 is a top plan view with the heel strap removed and the retaining strap in disengaged condition.

With particular reference to FIG. 2 it will be seen that inner sole 19 in its forward portion, overlying female fastener section 12 is provided with a longitudinally extending narrow slit 22 continuous at its rearward end with an annular opening 23 for reasons to be discussed hereinafter.

Figure 5:
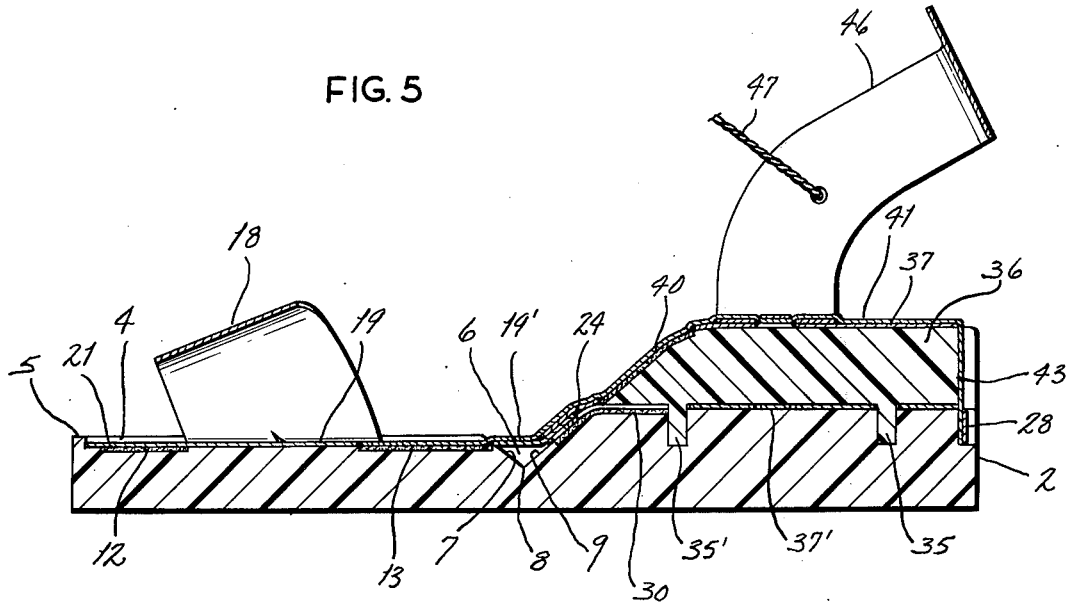
FIG. 5 is a vertical transverse sectional view taken substantially on the line 5—5 of FIG. 2.
Figure 6:
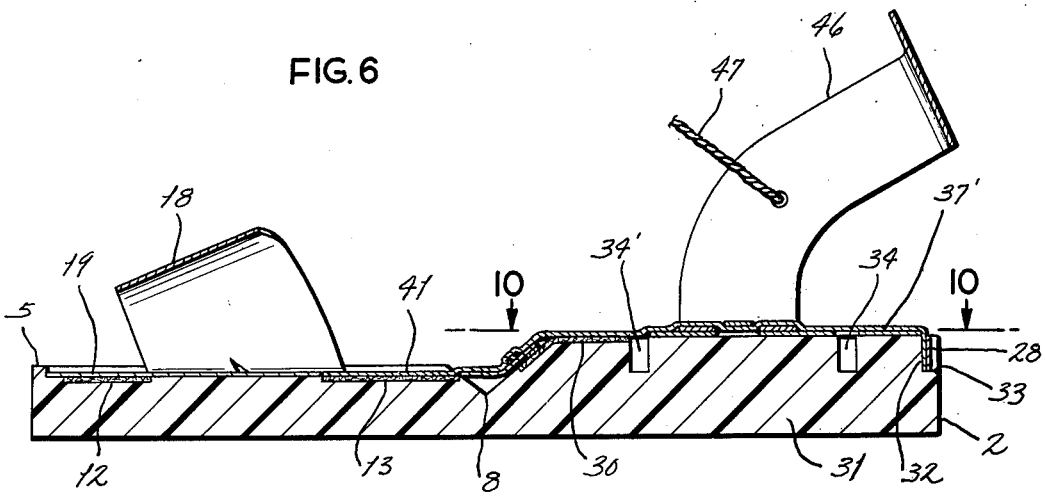
FIG. 6 is a vertical transverse sectional view taken substantially on the line 5—5 of FIG. 2, but with the upper heel section removed.

As may best be seen in FIGS. 5 and 6, inner sole 19 in its rearward portion bridgingly overlies the valley-like zone of flexure 6, as at 19', and continues upwardly a short distance along the forward face 3 of heel 2, and with the end extremity of inner sole 19 being indicated at 24. Said inner sole rear marginal portion 19' is unsecured and thereby adapted for relative slideable movement with respect to underlying and overlying components of shoe A to be described so as to be suitably flexible during bending of shoe A through the zone of flexure 6 during usage.

Heel 2 may, of course, if desired, be of unitarily formed construction having a base portion 25, a central portion 26 and an upper portion 27 for developing the desired height in general wedge formation and with the central portion 26 being marginally recessed as suggested at 26' for optional detachable disposition thereabout of a decorative band 28 (see particularly FIG. 10), said band having a height substantially commensurate with that of central portion 26 and being restrained against upward or downward displacement by reason of the restraining shoulders defining the upper and lower limits of the recess. Band 28 will be of any suitable type flexible material and provided on either or both faces with ornamentation, surface patterns, color arrangements or the like for coordination with the wearer's apparel and, of course, may be reversible if desired. Said band 28 is closed at its forward end as by an elastic section 29 which is stretchingly disposed against the forward face of said portion 26 which may be centrally provided on its inward face with an adhesive type component (not shown) for securement to a cooperative interlocking component 30 suitably affixed on the forward face of said central portion 26. Thus, band 28 is secure in operative position and may be easily removed for desired replacement; it being thus recognized that said band 28 endows shoe A with a marked element of versatility for rendering same coordinatingly useful with a multiplicity of ensembles.

Figure 1:
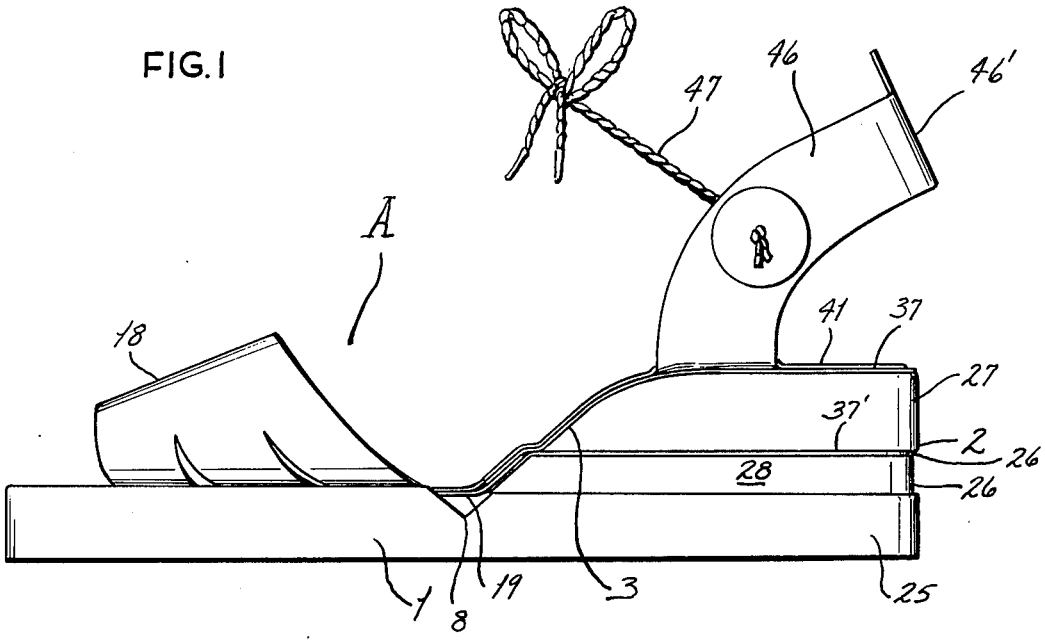
FIG. 1 is a side elevational view of an interchangeable sandal constructed in accordance with and embodying the present invention.

Heel 2 may, if desired, be comprised of a multiplicity of discrete interlockable components rather than being unitarily molded in order to accord the wearer with a variety of heel styles. Thus, heel 2 may comprise a bottom section 31 which is an integral part of sole 1 and constitutes the portion thereof rearwardly of the zone of flexure 6 so that with said heel so constituted shoe A assumes the character of a flat sandal. In its upper portion said heel bottom section 31 may be peripherally reduced, as at 32, to provide a shoulder 33 for receiving the bottom edge of decorative head 28 which is maintained in position thereon in the same manner as hereinabove described. Said heel bottom section 31 incorporates a pair of upwardly opening sockets 34,34' located preferably upon the longitudinal axis of the shoe for the optional snug reception of tenons or tongues 35,35', respectively, depending from the under surface of an upper heel section 36 and being formed integrally therewith. By means of said tenons 35,35' and their related sockets 34,34', heel sections 31,36 may be integrated to form a wedge-type heel as of the character shown in FIG. 1. Accordingly, the wearer has the option of utilizing the said sections 31,36 to provide either a lower or relatively high heel as may be desired.

The upper surface of heel 2, of section 36 if the heel is of multiple part character, is suitably covered by an upper inner sole 37 which in substantially its central portion is provided with a pair of axially parallel longitudinally spaced-apart transversely extending slot-like openings 38,38' for purposes to be described, and forwardly thereof as within the portion overlying the inclined forward face 3 is provided with an enlarged aperture 39 for exposure therethrough of a detachably lockable female component 40. The forward extremity of upper inner sole 37 terminates above and rearwardly of the zone of flexure 6 and is free being in overlying relationship to the rearward extremity of front inner sole 19 so that the same move slidingly relatively to each other during bending within the zone of flexure 6 during usage. Thus, the forward and rearward inner soles 19 and 37 bring about a unique relationship hitherto unknown in the industry by accommodating a novel zone of flexure. Were the ends of said inner soles 19,37 rigidly secured and, hence, not relatively movable, it is apparent that the requisite accommodation would not be achieved as the same would be tantamount to the conventional unitary insole.

Provided for integrating the components of shoe A is a retaining strap 41 the rearward portion of which extends downwardly along the rear face of heel 2 or heel sections 31,36 as the case may be, as within a rearwardly opening recess 42 for securement in any suitable manner, as by adhesives, fasteners, or the like to the adjacent heel rearward face, as at 43, whereby the said strap is thus securely anchored in its rearward zone. Said strap is led thence upwardly for overlying disposition upon the central zone of rear inner sole 37, thence downwardly thereover and into overlying relationship upon the rearward central portion of forward inner sole 19. Said strap 41 thus proceeds over the zone of overlap of said forward and rearward inner soles 19,37 and being unconnected within such particular zone so as to prevent interference to the limited relative slidability thereof during flexing of shoe A. On the under face of its forward portion retaining strap 41 has provided a section of male interlocking component 44 dimensioned for latchingly engaging the said female component 13 3xposed through inner sole 19 whereby the forward end of retaining strap 41 is securely but detachably affixed. Said strap 41 also contains on its under surface another section of male interlocking component 45 for union with the female component 40 exposed through rear inner sole 37. Thus, strap 41 when in engaged condition uniquely unites the rearward and forward portions of shoe A by securement to the inner soles 19,37.

Shoe A may be provided with a rear upper 46 being, for illustration only, as of the sling type, having a rearward portion 46' for disposition about the wearer's foot immediately above the heel. The sides of said sling 46 may be, if desired, interconnected by a lace 47. Sling 46 incorporates a base 48 for flatwise disposition upon rear inner sole 37, extending transversely thereof, and being centrally provided with an enlarged opening 49 for exposure therethrough of said openings 38, 38' whereby retaining strap 41 may be threaded through said openings 38,38' (see FIG. 2) thereby stabilizing rear upper 46 in wearing position. Manifestly, it is apparent that if desired shoe A may be utilized without upper 46 by merely withdrawing strap 41, removing said upper 46 and then returning strap 41 threadedly through said openings 38,38' or the same could overlie said openings 38,38' and thereby obscure said from view.

In the event heel 2 were to be comprised of the discrete companionable sections 31,36, a rear insole 37' of like character and construction as upper insole 37 would be provided upon the upper face of said lower heel section 31 and with strap 41 interengaging said forward and rearward inner soles 19,37' in like fashion and similarly operatively related to upper 46.

As further evidence of the extreme style interchangeability of shoe A, it will be seen with reference now being made to FIGS. 8 and 9, that a thong 50 as fabricated of leather or the like may be used to replace vamp 18 and thereby cause shoe A to present an entirely different appearance. With vamp 18 removed as by detachment of extensions 16,17 from hooks 14,15, respectively, and with forward inner sole 19 withdrawn, the forward end 51 of thong 50 is secured to female component 12 as by means of a cooperating male attaching section provided on the under face of said forward end 51 of thong 50 and then with thong 50 being flexed along its axis as though being doubled the same is extended through slit 22 and opening 23 in the forward portion of forward inner sole 19 which is thereupon directed downwardly into covering relationship upon the upper face of the forward portion of outsole 1 whereupon the projecting portion of thong 50 may be restored from double or bent condition into a substantially flat state for dispostion against the forward portion of the wearer's foot and being adaptable for securement in wearing position by reason of the threading of lace 47 through opening 52, 52' providing in thong 50 near its normally upper free end (see FIG. 8).

In view of the foregoing the extreme utilitarian character of shoe A without the loss of highly pleasing aesthetic qualities should be apparent. The various components are so uniquely inter-related as to permit shoe A to provide a multiplicity of current styles in a very facile manner and without particular skill on the part of the user. Thus shoe A may be presented as a flat sandal or, if desired, one having a wedge heel; may be provided with or without a heel sling or rear upper; or may be provided with an open toe vamp or simply a foot engaging thong. The simple maneuverability of retaining strap 41 assures of the integration of the components into the selected mode of wear. Additionally as pointed out decorative band 28 enhances the ornamental appearance of shoe A for promoting ease of coordination with the selected ensemble.

Having described my invention, what I claim and desire to obtain by Letters Patent is:

1. An article of footwear comprising an outsole of unitary molded construction having a forward portion and a rearward heel portion, there being a transversely extending, upwardly opening depression between said forward and rearward outsole portions constituting a zone of flexure, said depression comprising transversely extending first and second inclined surfaces, and upper-defining means detachably mounted on said outsole.

2. An article of footwear as defined in claim 1 and further characterized by a first insole detachably disposed upon said forward portion of said outsole and having a free rearward end portion overlying said zone of flexure, and a second insole disposed on said outsole rearward heel portion and having a forward portion underlying said rearward end portion of said first insole and being in relative slideable relationship thereto.

3. An article of footwear as defined in claim 1 and further characterized by a first insole detachably engaged on said forward position of said outsole, a second insole engaged on said outsole rearward portion, and a retaining strap for diposition longitudinally of said article of footwear, there being means anchoring the rearward end of said strap to said outsole heel portion, and means detachably securing said strap in overlying relationship upon said first and second insoles.

4. An article of footwear as defined in claim 1 and further characterized by said upper-defining means including a forward upper for disposition across the front upper face of said outsole forward portion, and disengageable cooperating means provided on said forward upper and said outsole for detachably securing said forward upper in wearing position, said front upper having opposed lateral marginal portions provided with a plurality of spaced apart openings, hook-forming elements fixed in said outsole engageable with the front upper openings, and a first insole overlying said hook-forming elements and said front upper engaged laterally marginal portions for obscuring of the same, and means detachably securing said first insole upon said outsole.

5. An article of footwear as defined in claim 4 and further characterized by said hook-forming elements being directly toward the interior of said outsole, said front upper lateral marginal portions being turned inwardly in general underlying relationship to the central portion of said front upper.

6. An article of footwear as defined in claim 5 and further characterized by said front upper lateral marginal portions being comprised of discrete finger-like extensions, at least selected of said extensions having a plurality of spaced apart openings for selected engagement with the related hook-forming element for providing width adjustability to said front upper.

7. An article of footwear as defined in claim 1 and further characterized by said upper-defining means comprising a thong, means detachably engaging the lower forward end of said thong upon the forward portion of said outsole for upper and rearward extension therefrom, and a rear-upper detachably engaged on said rearward heel portion, and means interengaging said thong and said rear-upper.

8. An article of footwear as defined in claim 1 and further characterized by said heel portion embodying a peripherally progressing, outwardly opening recess, and a decorative endless band for optional detachable reception in said recess.

9. An article of footwear as defined in claim 1 and further characterized by said upper-defining means comprising a sling having a base portion for receiving the wearer's heel, a heel insole disposed on said outsole heel portion underlying said sling base portion, and interlaceable means detachably securing said sling upon said heel insole.

10. An article of footwear as defined in claim 9 and further characterized by said heel insole having a pair of spaced apart transversely extending solt-like openings, said sling base having an enlarged aperture exposing said slot-like openings, and an elongated flexible member threadable through said slot-like openings and overlying the aperture-adjacent portions of said sling base.

11. An article of footwear as defined in claim 10 and further characterized by said flexible member being a retaining strap having a rearward end anchored to said heel portion in the rearwardly directed side portion thereof, and having a length greater than that of said heel portion, there being means for detachably securing said strap to said outsole portion.

* * * * *